United States Patent [19]

Poynter

[11] 4,300,473

[45] Nov. 17, 1981

[54] DEVICE FOR MOISTENING THE ADHESIVE COATING ON POSTAGE STAMPS AND ENVELOPES

[75] Inventor: Donald B. Poynter, Cincinnati, Ohio

[73] Assignee: Poynter Products, Inc., Cincinnati, Ohio

[21] Appl. No.: 169,860

[22] Filed: Jul. 17, 1980

[51] Int. Cl.[3] ..... B05C 1/02

[52] U.S. Cl. ..... 118/263; 118/264

[58] Field of Search ..... 118/263, 243, 264

[56] References Cited

U.S. PATENT DOCUMENTS 1,004,660 10/1911 Klotz ..... 118/267 X 1,729,170 9/1929 Lange ..... 118/263 X 4,079,695 3/1978 Stephens ..... 118/263

*Primary Examiner*—John P. McIntosh

*Attorney, Agent, or Firm*—Kinney & Schenk

[57] ABSTRACT

Apparatus for moistening adhesive coatings on postage material and the like which includes an enclosure having a container of liquid therein. A plunger is provided to lift an absorbant applicator from the liquid and pass the applicator through an opening in the side of the enclosure. A closure member for the opening is opened in response to the applicator movement. The applicator may be in the form of a human tongue and the closure may be in the form of a human lip.

7 Claims, 8 Drawing Figures

DEVICE FOR MOISTENING THE ADHESIVE COATING ON POSTAGE STAMPS AND ENVELOPES

BACKGROUND

The present invention relates to an apparatus for moistening the adhesive coating on a postage stamp, envelope or the like and more particularly concerns a novelty device for performing this function.

Due to the unpleasant taste of adhesive coatings placed upon postage stamps, envelopes and the like, many persons using such articles dislike licking the coating with their tongue. Many other persons object to licking stamps for reasons of health and sanitation or personal propensities. For these or other reasons, it is desirable to moisten the adhesive coating by means which do not include the use of the human mouth.

Further, many people obtain great satisfaction from novelty devices. Therefore, for many people, it is desirable to present an apparatus for performing the highly useful function of moistening adhesive coatings in a novelty arrangement.

It is accordingly an object of the present invention to provide an improved apparatus for moistening adhesive coating on postage stamps, envelopes and the like.

It is another object of the present invention to provide a moistening apparatus which maintains a moistening member disposed within a liquid immediately prior to contacting the moistening member with a postage stamp or the like.

It is a further object of the present invention to present a moistening apparatus which is packaged in a novelty arrangement.

SUMMARY OF THE INVENTION

In accordance with the invention, a device for moistening adhesive coatings on stamps and the like is provided. The device includes an enclosure member having an open top liquid container. A spring biased linkage member is pivotally mounted within the enclosure member and biased to a predetermined position. A moistening member is pivotally mounted to the linkage member about an axis substantially parallel to the linkage member's pivotal axis. The moistening member is movable from a first position in which it is disposed in the open top container to a second position in which it is extended outwardly from the enclosure member. A reciprocatingly movable plunger member engages the linkage member to force rotation thereof against the spring bias and to move the moistening member between first and second positions.

BRIEF DESCRIPTION OF THE DRAWINGS

Other objects and advantages of the invention will become apparent upon reading the following detailed description and upon reference to the drawings, in which.

While the invention will be disclosed in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
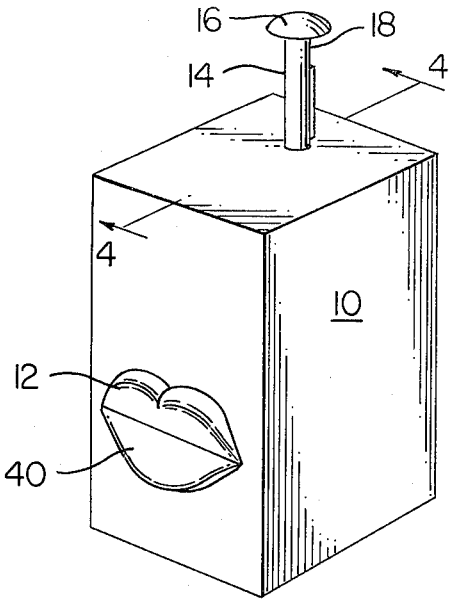
FIG. 1 is a perspective view of one embodiment of the invention in a normal or rest position with the tongue-like moistening member completely disposed within an enclosure member.

Referring now to the drawings and to FIG. 1 in particular, a box-like enclosure member 10 is shown with a closure member 12 configured to resemble the upper lip of a pair of human lips. A button-type actuator 14 having an enlarged button section 16 as well as a columnar extension 18 extends through the top of the boxlike closure member 10 for reciprocal movement in and out of the enclosure member 10.

Figure 2:
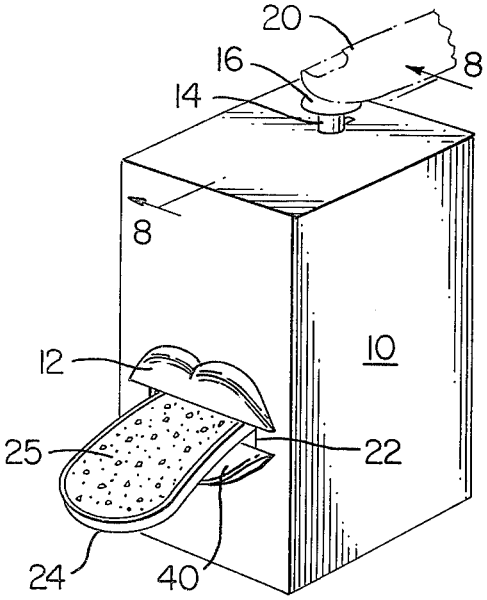
FIG. 2 is a perspective view of the embodiment of FIG. 1 depicting the depression of an actuator button and the extension of a tongue-like moistening member through an opening which is exposed through the movement of a closure member configured to resemble a human lip.

FIG. 2 shows this same enclosure member 10 with the actuator 14 depressed under pressure from a human finger 20. When the actuator 14 is depressed, the closure member 12 is moved from a first position illustrated in FIG. 1 to a second position depicted in FIG. 2, which movement exposes an opening 22 through which a moistening member 24 shaped like a human tongue extends. The tongue-like moistening member 24 contains an upper surface 25 which is formed of an absorbant sponge-like material capable of absorbing and retaining moisture.

Figure 3:
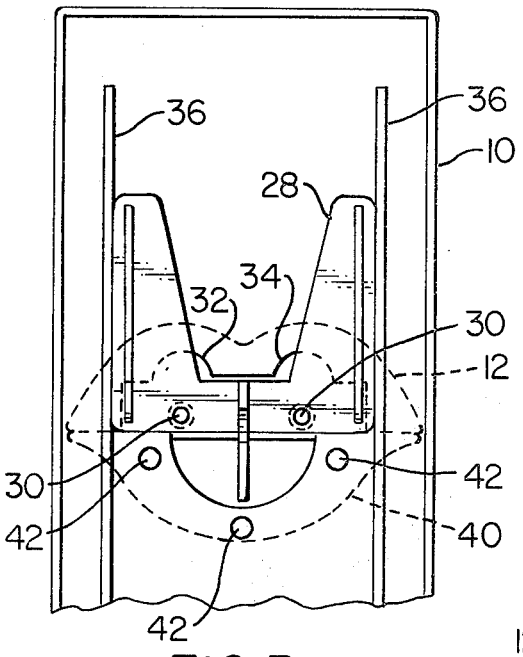
FIG. 3 is an elevational view, partially in cross section, of the interior of the enclosure member depicting a side or way system for the closure member.
Figure 4:
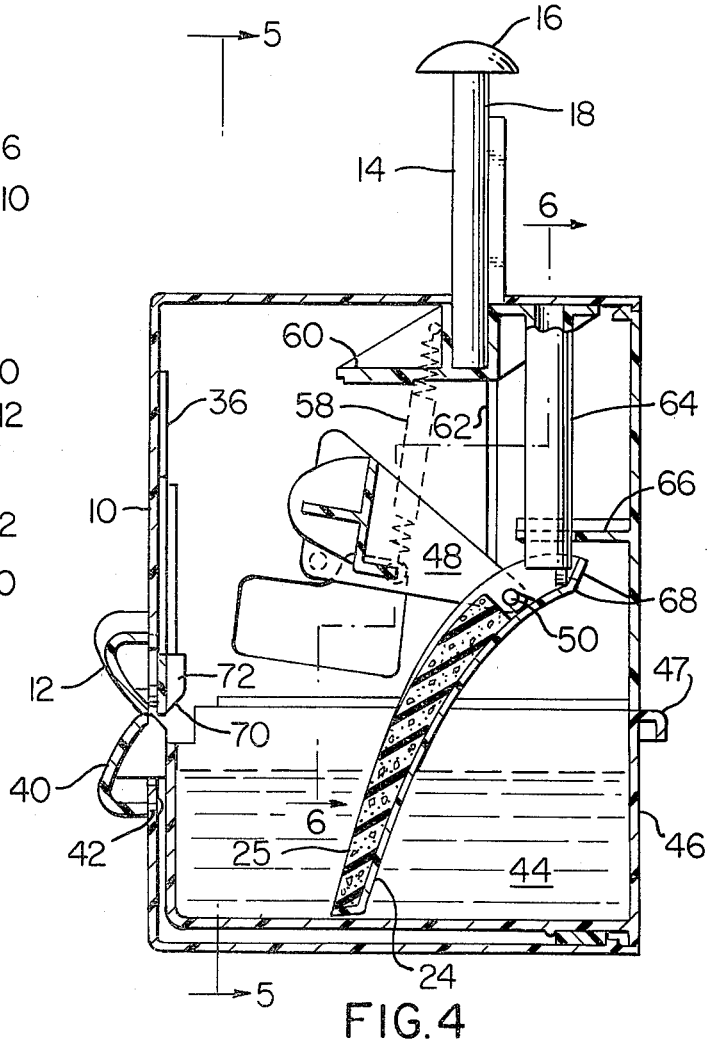
FIG. 4 is a cross sectional view taken along line 4—4 of FIG. 1 illustrating the internal linkage of the device of FIG. 1 and showing the tongue-like moistening member disposed in a liquid contained in an open top liquid container.

As shown most clearly in FIGS. 3 and 4, the closure member 12 has a backup plate 28 rigidly secured to the lip-like closure member 12 through pins 30. The backup plate 28 extends vertically above and horizontally beyond the limits of the opening 22. The opening 22 has elongated portions 32 and 34 above pins 30 to permit extended upward travel of the pins 30. A pair of guides 36 integral with the front portion of the enclosure member 10 run vertically along the side of the backup plate 28 to help guide movement of that backup plate 28. Thus, a guide or way system is provided which includes the side and top portions of closure member 10 adjacent the opening 22 and their cooperative relationship with the closure member 12 and the backup plate 28 as well as guides 26.

A lip configuration 40 is rigidly attached to the enclosure member 10 beneath the opening 22 by pins 42. This lip configuration serves to stimulate a lower lip to pair with the upper lip configuration of the closure member 12.

Figure 5:
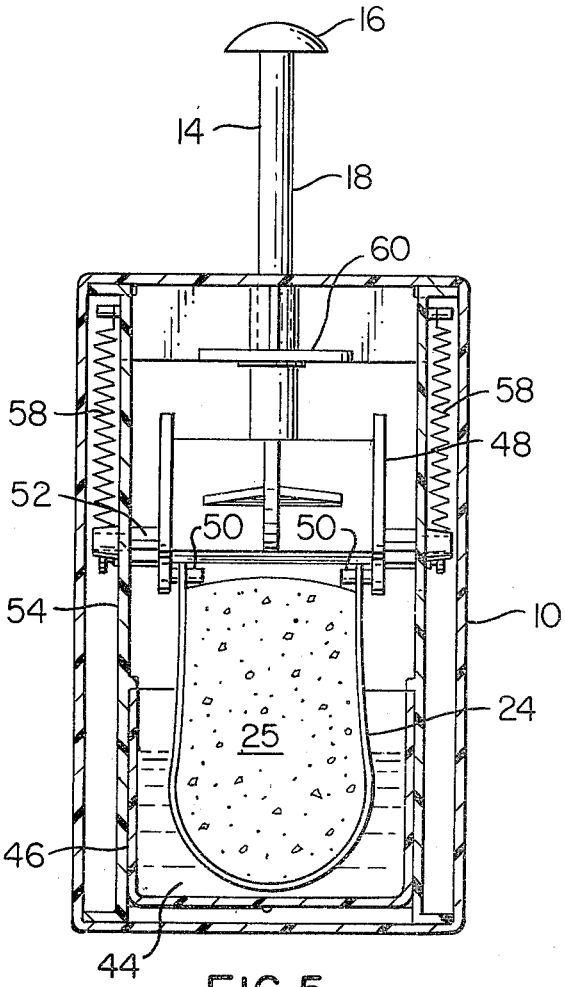
FIG. 5 is an elevational view, partially in cross section, taken along line 5—5 of FIG. 4 showing the internal components of the enclosure member.

FIGS. 4 and 5 depict the moistening member or tongue 24 in its first position disposed within a liquid 44, which is water in the preferred embodiment. The water 44 is constrained within the confines of a drawer-like liquid container 46. The container 46 is slidable into and out of the enclosure member 10. This sliding is achieved manually by grasping a handle 47 attached to the liquid container 46.

Figure 6:
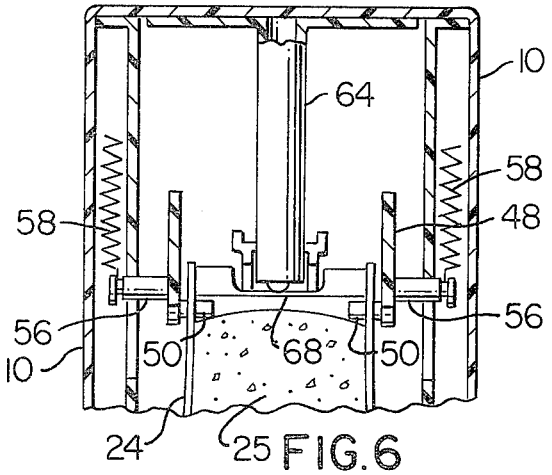
FIG. 6 is a sectional view taken along line 6—6 in FIG. 4 illustrating a plunger in engagement with the moistening member as well as springs secured to the linkage member.

The tongue 24 is suspended from a linkage member 48 from which it is pivotally attached about pins 50 on each side of the tongue 24 (only one pin 50 is illustrated in FIG. 4, the other pin is shown in FIGS. 5 and 6).

The linkage member 48 is, in turn, pivoted about lateral extensions 52 which project laterally into holes within enclosure partitions 54 of the enclosure member 10 in parallel relation to pins 52 as illustrated in FIG. 5.

As depicted in FIG. 6, the linkage member 48 also has a pair of spring connecting elements 56 projecting outwardly in parallel relationship to both the pins 50 and the lateral extension 52. Extension springs 58 are connected to enclosure member 10 upon one end and attached to connecting elements 56 at their opposite ends to urge the linkage member 48 to the predetermined angular position as illustrated in FIG. 4.

Figure 7:
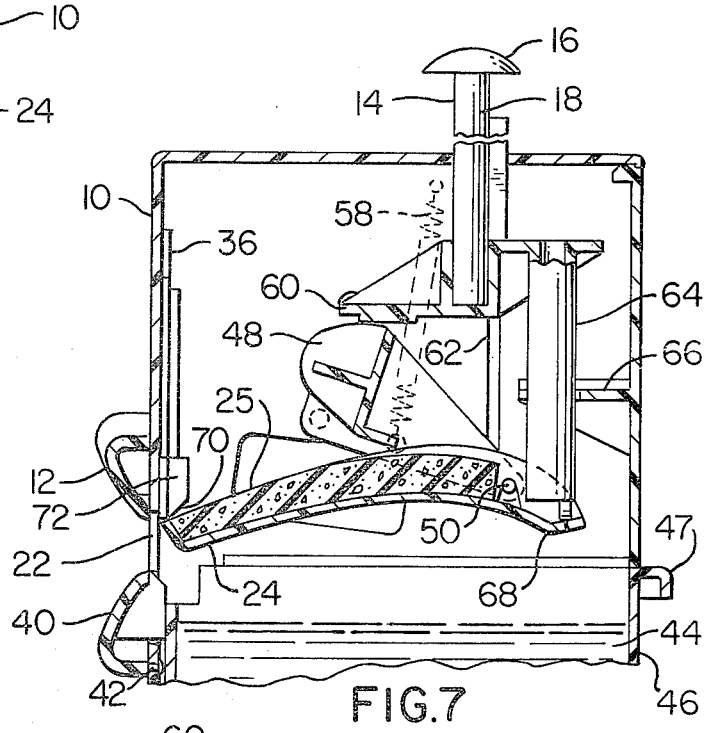
FIG. 7 is a sectional view depicting the moistening member engaging the closure member.
Figure 8:
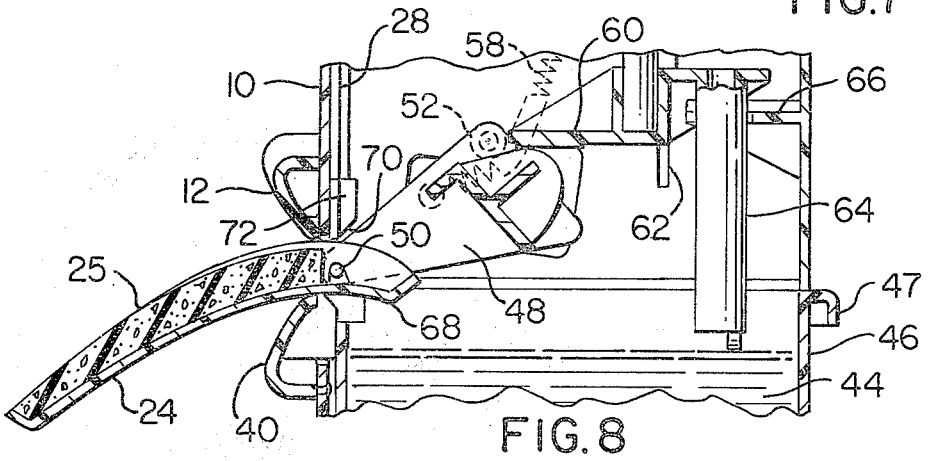
FIG. 8 is a sectional view taken along line 8—8 in FIG. 2 depicting the moistening member extending outwardly from the closure member.

The button-type actuator 14 engages a plunger member 60 which has lateral projections (not shown) guided for reciprocal vertical movement in slots 62 (see FIGS. 4, 6 and 8) in the enclosure partitions 54. The rear position of plunger 60 includes a cylindrical member 64 which is guided through an opening in a bracket 66 extending from the rear wall of the enclosure member 10. The cylindrical member 64 engages a portion 68 of the tongue member 24 during a first portion of the downward movement of the plunger member 60 to rotate the tongue 24 about the axis of pin 50 relative to linkage member 48 and to lift the tongue member 24 out of the water 44. Continued downward movement of the plunger moves the linkage member 48 and tongue 24 to the position depicted in FIG. 7 where the tongue 24 is urged against an inclined surface 70 of an abutment 72 secured to the closure member backup plate 28. This interaction urges the closure member 12 upwardly and permits the tongue 24 to extend outwardly from the enclosure member 10 as the linkage member 48 is pivoted further about the lateral extensions 52. This extended position is shown in FIG. 8.

In operation, when it is desired to moisten a postage stamp or the like, a user depresses button 16 and transmits a force through the columnar extension of the button type actuator 14 to the plunger 60. This force urges the plunger 60 downwardly and forces rotation of the linkage member 48 about the pivotal axis of extensions 52 against the bias of extension springs 48. During the initial portion of this rotation, the cylindrical member 64 engages portion 68 of tongue 24 to cause additional rotation of the tongue 24 about the axis of pins 50 causing the tongue to be moved from the orientation of FIG. 4 to a orientation roughly similar to that depicted in FIG. 7. Continued rotation of the linkage member 48 urges the tongue 24 into the engagement with the inclined surface 70 of abutment 72 shown in FIG. 7 forcing opening of closure member 12. The tongue 24 is then extended outwardly from the enclosure member 10, as depicted in FIG. 8, with further rotation of the linkage member 48.

Thus it is apparent that there has been provided, in accordance with the invention, a device that fully satisfies the objects, aims and advantages set forth above. While the invention has been described in conjunction with a specific embodiment thereof, it is evident that many alterations, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for moistening adhesive coatings on postage material and the like, comprising:

(a) an enclosure member;

(b) an open top liquid container disposed within said enclosure member;

(c) a spring biased linkage member pivotally mounted within the enclosure member and biased to a predetermined position;

(d) a moistening member pivotally mounted to the linkage member, said moistening member being movable from a first position in which it is disposed within the open top liquid container to a second position in which it is extended outwardly from the enclosure member;

(e) a plunger reciprocally movable within the enclosure member, said plunger engaging the linkage member for applying a force thereto non-coincident with the linkage member's pivotal axis to overcome its spring bias; and (f) a reciprocally movable closure member, said closure member being movable from a first position to a second position in response to a force transmitted by said moistening member for selectively closing and exposing of an opening in said enclosure member, said moistening member extending through said opening when said closure member is in its second position.

2. An apparatus as recited in claim 1 wherein said plunger engages said moistening member to effectuate pivotal movement of the moistening member relative to the linkage member.

3. An apparatus as recited in claim 2 wherein open top liquid container is slidable into and out of said enclosure member.

4. An apparatus as recited in claim 3 wherein said moistening member includes an absorbant sponge-like material capable of absorbing and maintaining moisture.

5. An apparatus as recited in claim 4 wherein said moistening member has a configuration resembling that of a human tongue.

6. An apparatus as recited in claim 5 wherein said closure member has a configuration resembling a human lip.

7. An apparatus as recited in claim 6 further including a lip configuration on said enclosure member disposed immediately beneath said closure member.

* * * * *